United States Patent [19]

Liu

[11] Patent Number: 4,805,825

[45] Date of Patent: Feb. 21, 1989

[54] SAFETY NAIL DRIVING DEVICE

[75] Inventor: Bao-Shen Liu, Taipei, Taiwan

[73] Assignee: Yun Yueh Liu Yang, Taipei, Taiwan

[21] Appl. No.: 125,141

[22] Filed: Aug. 13, 1987

[51] Int. Cl.[4] ..... B25C 1/02

[52] U.S. Cl. ..... 227/121; 227/124; 227/126; 227/127; 227/147; 227/149; 227/156

[58] Field of Search ..... 227/8, 121, 120, 124, 227/126, 127, 128, 147, 149, 125, 156

[56] References Cited

U.S. PATENT DOCUMENTS

| | | | |
|---|---|---|---|
| 2,783,468 | 3/1957 | Schwartz | 227/147 X |
| 2,997,713 | 8/1961 | Anstett | 227/147 X |
| 2,999,241 | 9/1961 | Starr | 227/126 |
| 3,012,247 | 12/1961 | Sillars et al. | 227/147 X |
| 3,022,509 | 2/1962 | De Man | 227/147 X |
| 3,245,596 | 4/1966 | Lygo | 227/147 X |
| 4,037,632 | 7/1977 | Arena | 227/147 X |
| 4,463,888 | 8/1984 | Geist et al. | 227/126 X |
| 4,524,896 | 6/1985 | Morrell, Jr. | 227/128 X |
| 4,621,758 | 11/1986 | Anstett | 227/147 |
| 4,624,401 | 11/1986 | Gassner et al. | 227/147 X |

*Primary Examiner*—Paul A. Bell

*Attorney, Agent, or Firm*—Roylance, Abrams, Berdo & Goodman

[57] ABSTRACT

The invention provides a multi-purpose safety device which can be used in conventional nailing operations to guide the nail to be driven safely, conveniently and quickly at a desired angle and which can be used for measuring angles and inclinations as well as levelling. The invention includes a driving member disposed in a sleeve which in turn mounted on an upper side of a housing, a nail advancing plate at one side of the housing for advancing nails, and a nail guiding body below the sleeve for guiding and positioning a nail beneath the driving member whereby the nail can be driven into an object by the driving member. An angle meter is further mounted in the housing for measuring angles as well as indicating a desired angle by which the nail has to be driven.

11 Claims, 7 Drawing Sheets

SAFETY NAIL DRIVING DEVICE

BACKGROUND OF THE INVENTION

The application relates to a safety nail driving device.

The operation of a current pneumatic nail driving device usually needs an air compressor to be connected to the device through a compressed air pipe. As a result, the pneumatic nail driving device is inconvenient and clumsy for nailing. Furthermore, the device is unsafe because of its nail shooting operation. In addition, it is expensive so that it is economically unsuitable for private use at home or for classroom use by students in a carpentry course. Finally, the presently used nail driving device can not be adjusted to drive a nail at a desired angle. Therefore, it is desirable to design a safety nail driving device for carpentry work performed at home and schools.

The invention is used when a nail is driven with a hammer and is designed to guide a nail so that the nail can be driven either vertically or at a desired inclination. The device according the invention is safe and convenient, even when the nail is rapidly hammered.

The invention provides a nail driving member which is mounted in a sleeve of a housing. Below the sleeve is a nail guiding body which has nail guiding plates for clamping one of a strip of nails which are advanced by a nailing transferring plate, thereby enabling the driving member to drive the nail into an object. This is a main object of the invention.

Another object of the invention is to provide an adjustable angle meter at one side of the housing of the nail driving device. The angle meter indicates the inclination of an object by using a vernier incorporating a mass and enables the device of the invention to guide the nail at a desired inclination.

A further object of the invention is to provide a bubble level unit at the intermediate portion of the housing so that the angle measuring unit can be set at 'zero' for levelling and measuring the inclination and the angle of an object.

BRIEF DESCRIPTION OF THE DRAWINGS

FIGS. 3, 3-1, 3-2 and 3-3 are a side sectional view and views showing specific parts of the device;

DETAILED DESCRIPTION OF THE PREFERRED EMBODIMENT

Figure 1:
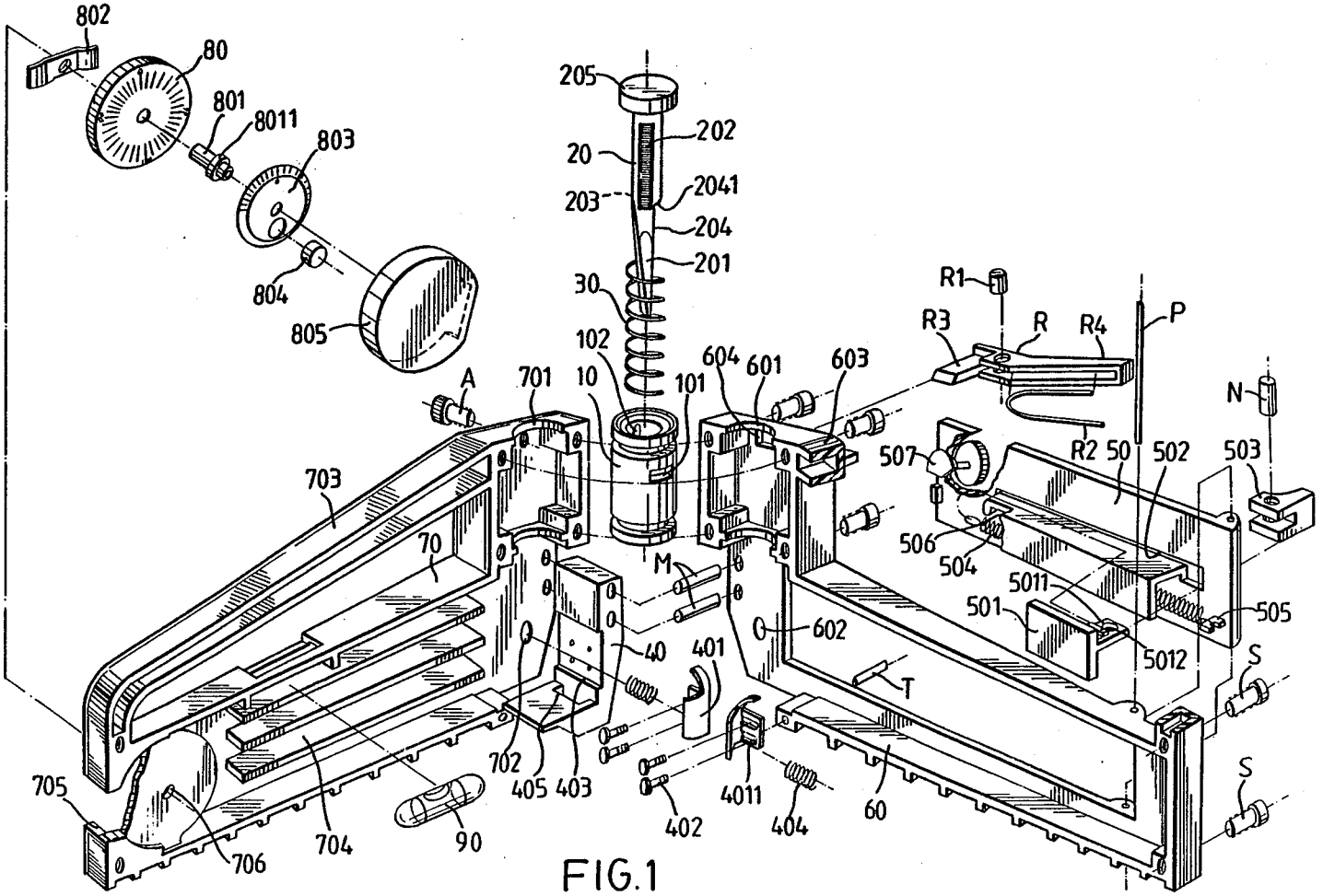
FIG. 1 is an exploded view of a nail driving device of the invention.
Figure 2:
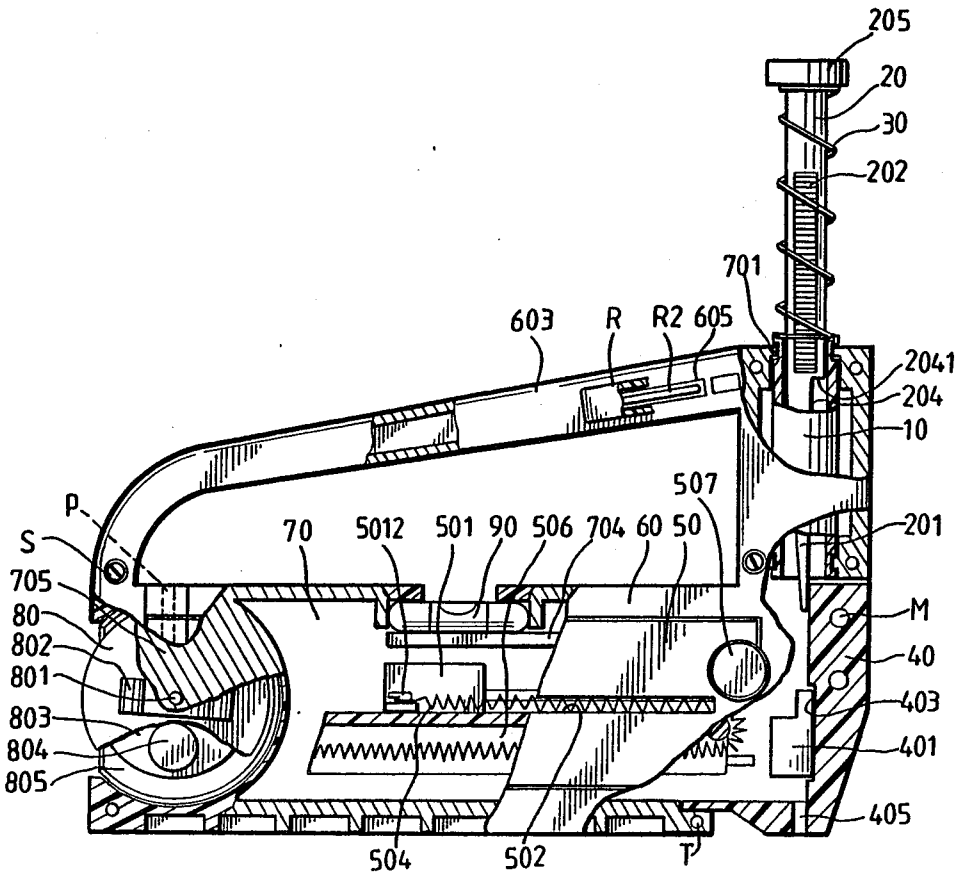
FIG. 2 is a front sectional view of the nail driving device.

Referring to FIG. 1 and 2, a preferred embodiment of the invention includes a sleeve 10 disposed in recesses 601 and 701 at the upper portions of two housing parts 60 and 70. In the sleeve 10 is a driving member 20 which has a tapered driving portion 201 extending from its intermediate portion to one of its ends. Rack teeth 202 are provided on the driving member 20. Between the driving member 20 and the sleeve 10 in a spring 30 which urges the driving member 20 to return to its original position after operation. At the lower side of the sleeve 10 is a nail guide body on which are mounted two nail clamping plates 401 which are curved and diverge upwardly. One each nail clamping plate 401 are two through-holes 4011. By means of these through-holes 4011 and studs 402 each nail clamping plate 401 is attached movably in a recess 403 of the nail guide body 40. Between the nail clamping plates 401 and respective openings 602 and 702 of the walls of the housing parts 60 and 70 are provided respectively springs 404 for urging the clamping plates 401 so as to clamp one of a strip of nails below the driving member 20 such that the nail is aligned with the the driving member 20. The nail guiding body 40 is used for the purpose of mounting the nail clamping plates. Besides, it has another function of transferring the remaining impact pressure of the driving member to the object which is in contact with the device of the invention after the nail is completely driven into the object, thereby removing the impact pressure from the device.

The nail guide body 40 is substantially vertical and has a nail outlet 405 at its bottom side. The nail guide body 40 is secured to the housing parts 60 and 70 by means of two studs M. At one side of the housing part 60 is attached a panel 50 on which is disposed an advancing plate 501. The advancing plate 501 has a transverse projecting plate 5011 which extends out of the panel 50 through a longitudinal opening 502 and is provided with a knob 503 which is secured to the projecting plate 5011 by means of a stud N. On the panel 50 is further disposed a spring 504 which has one end anchored to a hook 505 of the panel 50 and the other end passing through a channel-shaped guide plate 506, then turning to the upper side of the guide plate 506 and secured to a hook 5012 of the advancing plate 501. By means of the spring 504, the advancing plate 501 can advance a strip of nails to the nail guide body 40 so as to continuously supply nails for being driven by the driving member 20. The panel 50 is connected pivotally to one side of the housing part 60 by means of a pin P so that the panel 50 can be placed in an open position or a closed position. At the end of the panel 50 is a locking member to retain the panel 50 in a closed position relative to the housing part 60.

At the upper side of the housing part 60 is a stop lever R which is pivoted to an end of a member 603 of the housing part 60 by means of a stud R1. At the front end of the stop lever is a dog plate R3 which is inserted into a through-hole 604 of the housing part 60 and a through-hole 101 of the sleeve 10. A spring R2 is disposed in a groove R4 of the stop lever and in a groove 605 of the housing part 60 and urges the dog plate R3 to engage with the rack teeth of the driving member 30. The stop lever is aimed to prevent the driving member 20 from moving away from the nail before the nail is driven into an object. This enables the user to estimate the depth of the nail and permits the nail to directly receive an impact pressure.

At the intermediate portion of the housing part 70 are longitudinal projecting plates 704 to cooperate with the channel-shaped guide member 506 of the panel 50 to receive a strip of nail in a confined space between the guide member 506 and the longitudinal projecting plates 704.

At the other side of the housing part 70 is provided an angle meter which has a graduated disc 80 mounted in a circular recess 705 together with a spring 802 by means of a pin 801. The end of the pin 801 is fixed in a hole 706 in the circular recess 705, thereby holding the graduated disc 80 and the spring 802 in the circular recess 705 and depressing the graduated disc 80 against the spring 802 by means of a cap 8011 of the pin 801. The spring 802 provides a retaining force when the graduated disc 80 is turned for adjustment of angle so that the graduated disc 80 does not displace easily from an adjusted angular position.

A vernier member 803 is disposed at the free end of the pin 801, which incorporates a weighing mass 804 to index an angle between the device of the invention and the object to be nailed, whereby a nail can be driven into the object at a desired angle and the angle between the present device and the object can be determined with the angle meter.

A transparent cover 805 is further disposed in the recess 705 to enclose an adjustable levelling unit. In the housing part 70 is a bubble level means 90 which is used for determining the level of the object to be nailed as well as for levelling so that the graduated disc 80 of the angle meter can be adjusted at 'zero' when determining the inclination of the object.

Figures 2, 3:
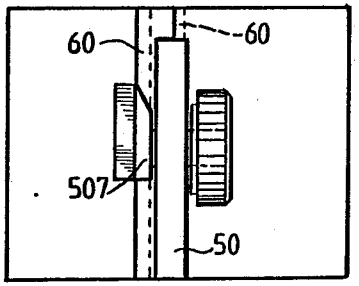
Figure 3:
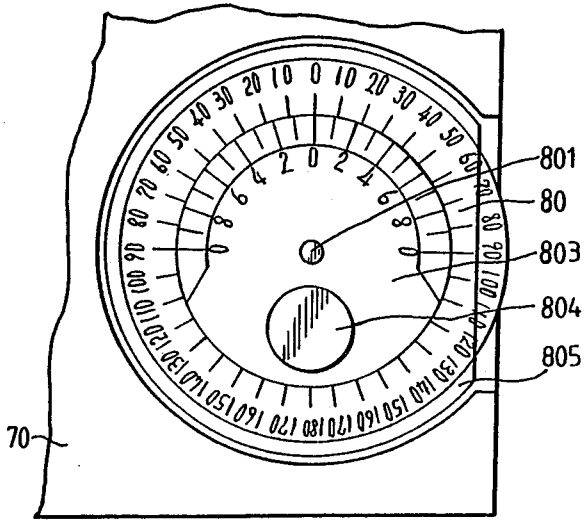
Figures 1, 3:
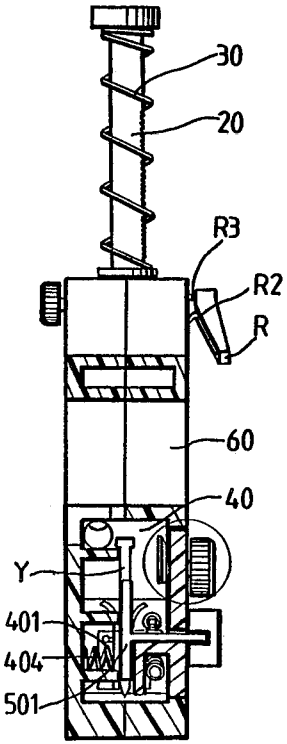
Figure 3:
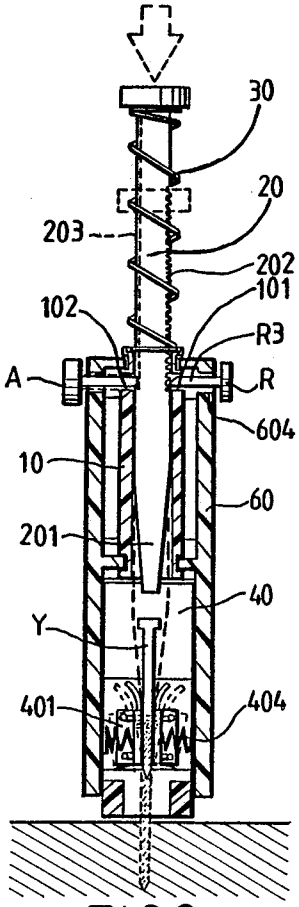

Referring to FIGS. 3 and 3-1, the nail Y is clamped by the nail clamping plates 401 of the nail guiding body 40 below the driving member 20 for being hammered properly by the driving member 20 into an object. The converging upper end portions of the nail guiding plates 401 prevent the head of the nail from engaging with the nail clamping plates when the nail head is driven so that the nail head and the tapered clamping portion 201 can be driven past the upper end portions of the nail clamping plates 401. When the nail head is driven past the upper end portions, the nail clamping plates 401 move away from one another due to the downwardly moving nail head, thereby enabling the nail head to be driven smoothly into the object. After the driving member 20 drives the nail Y into the object and returns to its original position in which no external force exists thereon, the nail clamping plates return to their original positions by means of the spring 404 for clamping a next nail transferred from the nail advancing plate.

In order to prevent the driving member 20 from moving away from the nail by the force of the spring 30 before the nail is driven completely into the object, a stop lever R is provided, which includes a dog plate R3 extending through a hole 604 of the housing part 60 and a hole 101 of the sleeve 10. By means of a spring R2 of the stop lever, the dog plate R3 can engage tightly with the rack teeth 202 of the driving member 20. As such, the driving member 20 will not be urged by the spring 30 and thus continue to act on the nail Y. When the driving member receives an external force and drives the nail completely into the object, the driving member 20 is allowed to return to its original position by the spring 30 upon depression of the lever R for its next operation. In order to prevent the driving member 20 from escaping out of the sleeve 10, a screw A is further inserted into a screw hole 102 of the sleeve 10 and then caused to engage with a recess 203 of the driving member 20.

Referring to FIG. 3-2, the locking member 507 disposed on the panel 50 at one side of the housing part 60 is substantially in the form of a roller which has a tapered inclined surface to engage with the side of the housing part 60 to place the the panel 50 in a closed position or an open position for replacement or supplement of nails.

Figure 4:
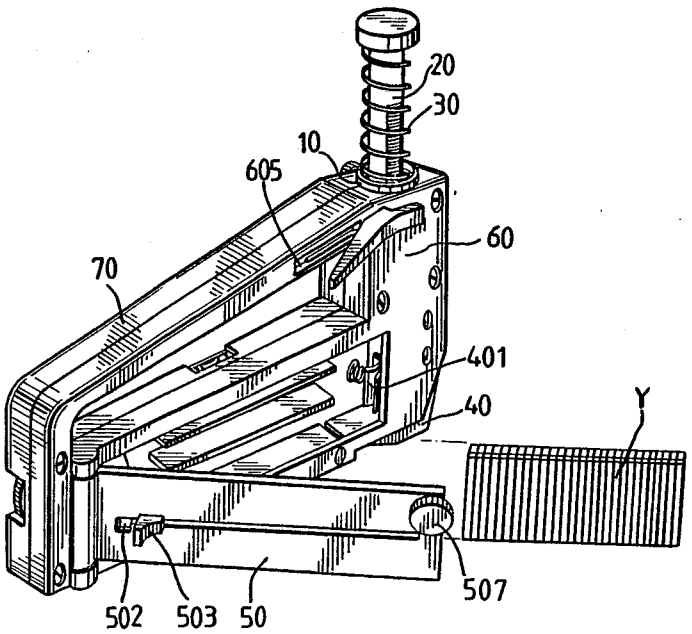
FIG. 4 is a perspective view as viewed from the right of the device.

Referring to FIG. 4, when in use, the knob 503 is first pulled rearwardly and kept at one end of the opening 502, then the panel 50 is opened and a strip of nails Y (the strip of nails used in the invention is similar to that used in the pneumatic nail driving device) is placed in the housing, thereafter the panel 50 is closed and locked against the housing part 60 by turning the locking member 507. When the knob 503 is released from the groove 502, the nails are advanced by the nail advancing plate 501 and sent to the nail clamping plates 401.

Figure 6:
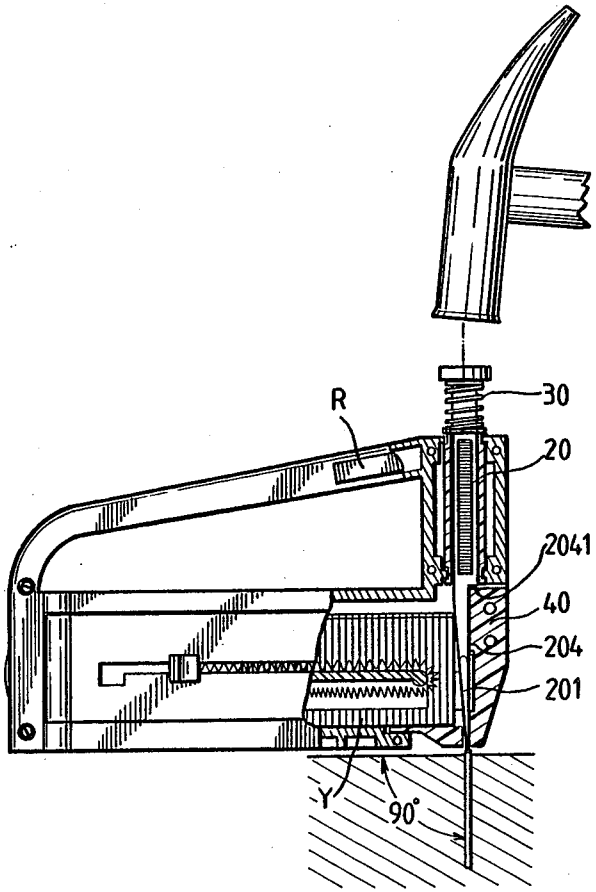
FIG. 6 shows an application of the nail driving device.

Upon finishing of the above operation, the device of the invention is put on an object as shown in Figure 6, and blows are given to the driving member by a hammer so that one of the nails Y is driven into the object by the impact pressure of the tapered driving portion 201. When the driving member 20 drives the nail Y completely into the object, an angle surface 2041 of a vertical recessed face 204 of the driving member 20 reaches at the upper portion of the nail guiding body 40 and transfer the remaining impact pressure to the guiding body 40 which in turn transfers the same to the object, thereby reducing the impact acting on the present invention. Since the vertical recessed face 204 abuts with the inner side of the nail guiding body 40, the driving member 20 can be prevented from rotation. The gradually inclining configuration of the tapered driving portion 201 is provided for increasing the strength of the driving portion 201. When it is desired to drive a next nail after the former nail is completely driven into the object, one can depress the stop lever R to permit the driving member 20 to return to its original position by the spring 30 for driving a next nail.

Figure 5:
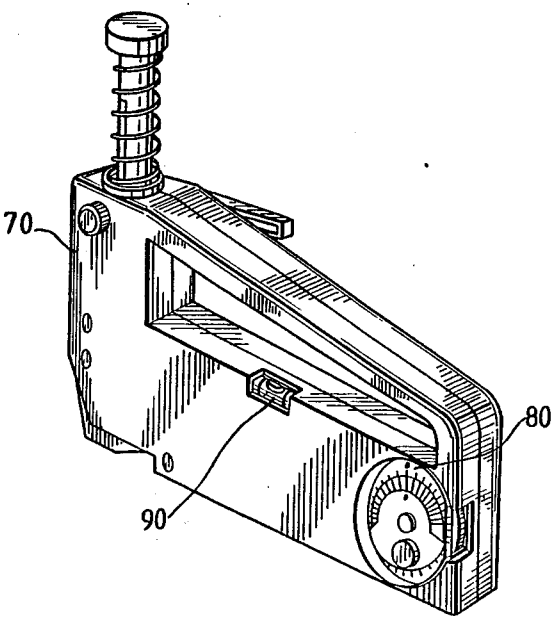
FIG. 5 is a perspective view as viewed from the left of the device.
Figure 7:
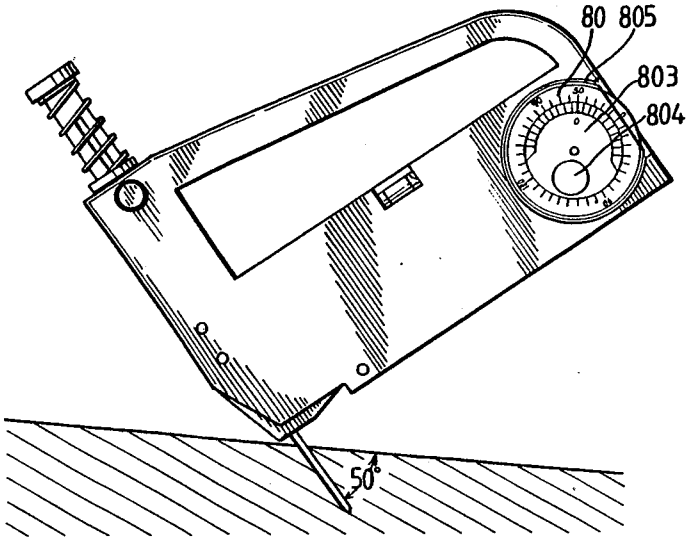
FIG. 7 shows another application of the nail driving device.

Referring to FIG. 5, when it is desired to drive a nail into an object at an angle, the device of the invention is placed horizontally on the object and the graduated disc 80 of the angle meter is adjusted to 'zero' or at a desired angle (for instance, 90 degrees between the nail and the object). Then, the device is tilted until the desired angle is indexed by the vernier on the graduated disc. Finally, the object is nailed as shown in FIG. 7.

Figure 8:
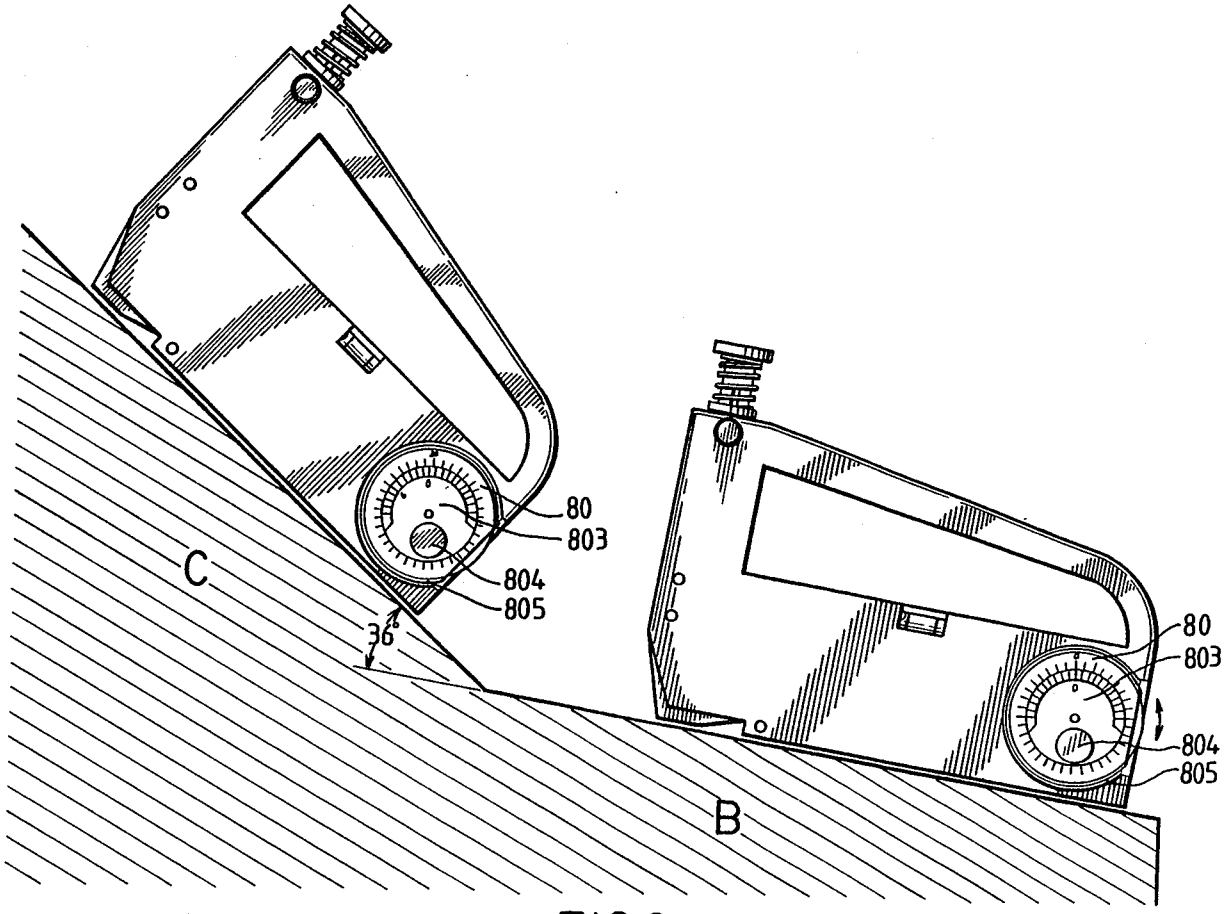
FIG. 8 shows still another application of the nail driving device.

The present invention can be used not only for driving nails but also for measuring the angle of an object. Referring to FIG. 8, in measuring an angle of an object, the device of the invention is first placed on a surface B of the object, then the graduated disc is adjusted to 'zero'. Thereafter, the device is placed on another surface C of the object where the vernier scale indicates the angle of the surface C relative to the surface B. The angle can be read from the graduated scale shown in FIG. 3-3.

Since a bubble level means 90 is provided in the housing part 70, the present invention can be used for levelling and detecting an inclination of an object in addition to its application in nail-driving and angle-measuring. In application, the device of the invention is first placed horizontally by means of the bubble level means 90 so as to let the graduated disc 80 to be adjusted to 'zero'. Then, the device can be placed on an object for determining the inclination of the object. Please refer to FIG. 6.

Figure 9:
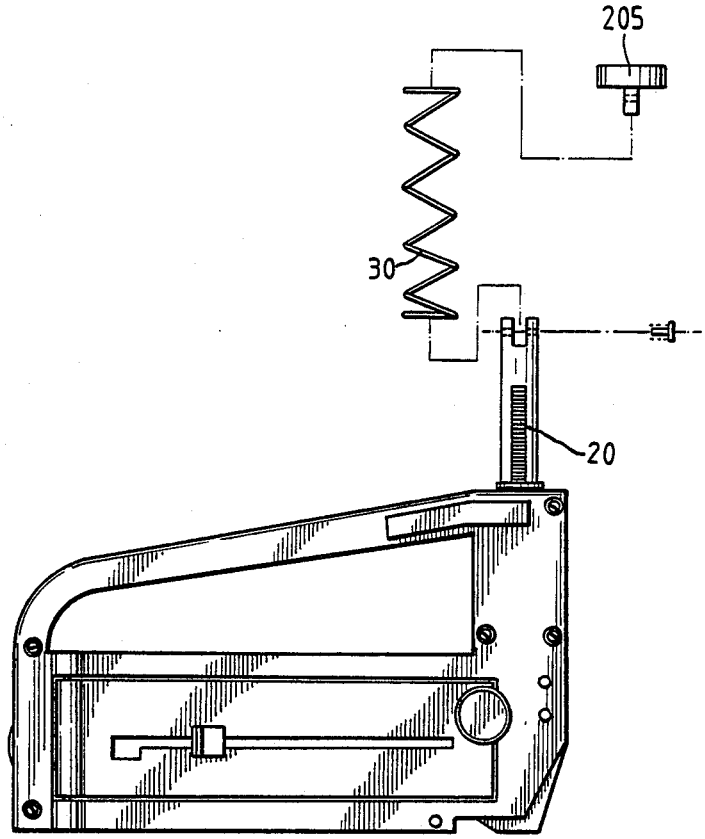
FIG. 9 shows a nail driving device of another embodiment.

In another embodiment of the invention which is shown in FIG. 9, the invention includes a nail driving member 20 arranged to have a separable head 205 which permits the replacement of the spring 30 between the nail driving member 30 and the sleeve.

In view of the foregoing, although a nail driving operation must still be accomplished by using a hammer as done conventionally when the invention is used, the operation can be performed more quickly, safely and conveniently by using this invention. Moreover, the invention enables a nail to be driven at a desired angle and effects measurement of the inclination and angle of the object and levelling of an object. It can be appreciated that the invention is suitable for use at home or in school as well as for carpenters.

I claim:

1. A nail guiding device for use in driving a nail from a strip of nails, comprising:

a housing having a longitudinal first wall with an access opening, and a longitudinal second wall opposite to said first wall;

a panel for covering said access opening, hinged to said first wall, said panel being movable between an open position and a closed position and including a longitudinal first nail guiding member projecting therefrom into said housing;

a locking means for retaining said panel in said closed position;

a longitudinal second nail guiding means disposed on said second wall, said second nail guiding means cooperating with said first nail guiding member to confine a longitudinal narrow space for receiving the strip of nails when said panel is in said closed position;

a nail advancing member mounted movably in said housing for moving within said narrow space, said advancing member being urged to a first direction to advance the nails;

means for urging said advancing member in said first direction;

a third nail guiding means mounted in said housing at one end of said narrow space in said first direction, said third nail guiding means having a bottom nail outlet;

two nail clamping plates attached movably to said third nail guiding means above said nail outlet for moving between a clamping position and a releasing position and being urged to the clamping position;

a nail driving member mounted in said housing in a vertically movable position and having a portion extending out of said housing for being hammered by a tool, said driving member having a lower driving portion to transmit an impact pressure to the nail.

2. A nail guiding device as claimed in claim 1, wherein said panel has a longitudinal opening, and said nail advancing member includes an upstanding plate received in said narrow space, a transverse plate connected to said upstanding plate and extending outwardly through said longitudinal opening, a knob attached to said transverse plate outside said housing for being moved manually against said urging means.

3. A nail guiding device as claimed in claim 2, wherein said first nail guiding member is a longitudinal plate which has a first portion extending inwardly from said panel and a second portion turning downward, said upstanding plate of said advancing member being in sliding contact with said second portion and said transverse plate being placed slideably on said first portion.

4. A nail guiding device as claimed in claim 3 wherein said urging means includes a helical spring which has one end fixed to said panel below said first portion of said first nail guiding member and the other end extending in said first direction and turning back oppositely above said first portion and then fixed to said transverse plate of said advancing member.

5. A nail guiding device as claimed in claim 4, wherein said second nail guiding means includes a plurality of longitudinal plate members projecting inwardly from said second wall.

6. A nail guiding device as claimed in claim 5, in which said third nail guiding means includes a fixed upstanding body which includes a bottom part having said bottom nail outlet, and a vertical recessed face above said bottom part adjacent to said clamping plates, wherein said clamping plates are curved plates which are attached slideably to said recessed face, said clamping plates diverging upward as well as diverging toward said narrow space.

7. A nail guiding device as claimed in claim 6, wherein said housing includes a sleeve mounted fixedly therein above said third nail guiding means, said nail driving member being mounted movably in said sleeve.

8. A nail guiding device as claimed in claim 7, wherein said nail driving member is an elongated member having a topmost head extending outwardly of said sleeve and a spring member disposed between said head and said sleeve for urging upward said topmost head.

9. A nail guiding device as claimed in claim 7, further comprising a stop means for restricting releaseably said nail driving member to move upward, said stop means including a dog member which is mounted pivotally in said housing and which has one end extending into said sleeve to engage with said nail driving member and the other end extending out of said housing, said dog member being normally urged to engage with said nail driving member, and a stop lever fixed to said other end of said dog member, wherein said nail driving member has rack teeth provided thereon to engage with said dog member.

10. A nail guiding device as claimed in claim 9, further comprising a bubble level means mounted on said housing to cooperate with said angle meter.

11. A nail guiding device as claimed in claim 1, further comprising an angle meter which includes a graduated disc mounted on one of said first and second walls, a vernier mounted coaxially and movably relative to said graduated disc, a weighing mass attached to said vernier for placing said vernier by gravity in a position in which said vernier indexes vertically upward.

* * * * *